US009188029B2

(12) United States Patent
Busse

(10) Patent No.: US 9,188,029 B2
(45) Date of Patent: Nov. 17, 2015

(54) CAMSHAFT ADJUSTER

(71) Applicant: Schaeffler Technologies GmbH & Co. KG, Herzogenaurach (DE)

(72) Inventor: Michael Busse, Herzogenaurach (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 0 days.

(21) Appl. No.: 14/395,003

(22) PCT Filed: Mar. 20, 2013

(86) PCT No.: PCT/EP2013/055754
§ 371 (c)(1),
(2) Date: Oct. 16, 2014

(87) PCT Pub. No.: WO2013/178374
PCT Pub. Date: Dec. 5, 2013

(65) Prior Publication Data

US 2015/0068478 A1 Mar. 12, 2015

(30) Foreign Application Priority Data

May 30, 2012 (DE) ..... 10 2012 209 027

(51) Int. Cl.
*F01L 1/34* (2006.01)
*F01L 1/344* (2006.01)

(52) U.S. Cl.
CPC ..... *F01L 1/34413* (2013.01); *F01L 1/3442* (2013.01); *F01L 2001/34459* (2013.01); *F01L 2001/34466* (2013.01)

(58) Field of Classification Search
CPC ..... F01L 1/3442; F01L 1/34413; F01L 2001/34459; F01L 2001/34466
USPC ..... 123/90.15, 90.17
See application file for complete search history.

(56) References Cited

U.S. PATENT DOCUMENTS

| | | | | |
|---|---|---|---|---|
| 8,240,280 | B2 * | 8/2012 | Busse | F01L 1/3442 123/90.15 |
| 2002/0038640 | A1 | 4/2002 | Fujiwaki et al. | |
| 2008/0289595 | A1 | 11/2008 | Strauss | |
| 2010/0037841 | A1 | 2/2010 | Strauss et al. | |
| 2011/0139100 | A1 | 6/2011 | Busse et al. | |

FOREIGN PATENT DOCUMENTS

| | | |
|---|---|---|
| DE | 10 2005 060 829 | 7/2007 |
| DE | 10 2007 007 073 | 8/2008 |
| DE | 10 2007 007072 | 8/2008 |
| DE | 10 2008 036877 | 2/2010 |
| EP | 0 799 977 | 10/1997 |
| EP | 1 672 187 | 6/2006 |
| EP | 2 372 118 | 10/2011 |

* cited by examiner

*Primary Examiner* — Ching Chang
(74) *Attorney, Agent, or Firm* — Davidson, Davidson & Kappel, LLC

(57) ABSTRACT

A camshaft adjuster having a first component, a second component rotatable relative to the first component within an angular range, and a locking device for locking the first component relative to the second component. The locking device includes a first locking bolt and a second locking bolt on the first component and a central slotted guide on the second component, and wherein the two locking bolts are movably guided between a locking position and an unlocking position and engage in the central slotted guide in a central angular position relative to one another in their locking position. At least one terminal slotted guide, in which the first locking bolt or the second locking bolt engages in its locking position in a terminal angular position differing from the central angular position of the components, is arranged on the second component.

9 Claims, 15 Drawing Sheets

Fig. 1 (is not part of the invention)

CAMSHAFT ADJUSTER

The present invention relates to a camshaft adjuster having a first component, a second component which is rotatable relative to the first component around a rotation axis within an angular range and a locking device for locking the first component with respect to the second component, the locking device including a first locking bolt and a second locking bolt on the first component and at least one central slotted gate on the second component, and the two locking bolts being movably guided between a locking position and an unlocking position and engaging with the one central slotted gate in their locking position in a central angular position of the components with respect to each other.

BACKGROUND

Camshaft adjusters are industrial modules for adjusting the phase angle between a crankshaft and a camshaft in an internal combustion engine. One of the components, also known as the stator, is rotatably fixedly connected to the crankshaft. The other component, also known as the rotor, is rotatably fixedly connected to the camshaft and rotatably supported relative to the stator. In a hydraulic camshaft adjuster, the stator usually includes a number of separating elements, between which a vane element of the rotor is situated. The vane element divides the space between two adjacent separating elements into an advance chamber and a retard chamber. Both chambers are connected to switchable pressure medium lines. If a pressure medium is applied to the advance chamber via the associated pressure medium line, and if the pressure medium line of the retard chamber is connected to a pressure medium outlet, the rotor is moved in an advance direction with respect to the stator and vice versa. If pressure medium is applied to both chambers, or if the pressure medium lines are blocked, the rotor is hydraulically fixed at the set phase angle with respect to the stator.

The hydraulic camshaft adjuster is usually integrated into the lubricant circuit of the internal combustion engine for the purpose of supplying pressure medium. In a start phase of the internal combustion engine, the pressure of the lubricant (oil pressure) is generally not yet sufficient for flawless operation of the camshaft adjuster. The rotor may oscillate in an uncontrolled manner within the permitted angular range and possibly strike the stator, which results in an undesirable acoustic abnormality. For this reason, hydraulic camshaft adjusters usually have a mechanical locking device which locks the two components which are rotatable relative to each other, i.e., the rotor and stator, in a defined angular position with respect to each other during a standstill or in a start phase of the internal combustion engine. Due to the building pressure of the lubricant, the lock is released, so that the rotor and stator may be adjusted with respect to each other during operation of the internal combustion engine.

The angular position in which the rotor and stator of a hydraulic camshaft adjuster are mechanically locked with respect to each other is usually indicated as an advance or a retard. In other words, in the locked angular position, the rotor strikes a separating element in either in the advance position, i.e., for example in the clockwise direction, or in the retard position, i.e., for example in the counterclockwise direction. A hydraulic camshaft adjuster is also known from EP 0 799 977 A1, in which the two rotatable components are locked to each other in a central angular position between the advance position and the retard position during the standstill. This provides thermodynamic advantages for the correspondingly operated internal combustion engine. In this position, a locking bolt on the one component engages with a correspondingly situated central slotted gate on the other component for the purpose of locking.

A camshaft adjuster of the type mentioned at the outset is known from EP 1 672 187 A1. A central slotted gate is provided herein, with which both locking bolts engage in a central angular position when the two components are locked with respect to each other. Due to this design, a simplified locking of the components in the central position is possible. When the rotating components are locked, one of the locking bolts first enters the central slotted gate, which is widened accordingly in the direction of rotation, and forms a stop therein only upon further rotation. In the defined stop position, the second locking bolt may enter the central slotted gate, so that the two components finally lock in both directions of rotation in a fixed angular position with respect to each other.

A camshaft adjuster of the type mentioned at the outset is also known from DE 10 2005 060 829 A1. Two locking bolts for locking the two components in a central angular position are provided herein, each of which engages with a separate central slotted gate. A third and a fourth locking bolt are additionally provided, which lock the components in an advance position and in a retard position with respect to each other via a first and a second end slotted gate.

Finally, a camshaft of the type mentioned at the outset is also proposed in DE 10 2007 007 073 A1. Herein, the components of the camshaft adjuster may be locked in a total of three different positions with respect to each other, namely in an advance position, in a retard position and in a central adjusting position, with the aid of a total of three locking bolts and three slotted gates.

SUMMARY OF THE INVENTION

In principle, it is desirable to offer a camshaft adjuster which ensures mechanical locking in a central angular position as well as in an end angular position of the components with respect to each other. The approaches according to the prior art known previously use at least three locking bolts for this purpose, which engage with corresponding slotted gates to ensure a secure lock, in particular in the central angular position. However, each locking bolt disadvantageously takes up additional installation space, which is often not available, depending on the structural design of the camshaft adjuster, or which would undesirably increase the overall size of the camshaft adjuster.

It is an object of the present invention to provide a camshaft adjuster of the type mentioned at the outset, which may be locked in at least two different angular positions of the rotatable components with respect to each other but which requires only a preferably small number of locking bolts.

The present invention provides a camshaft adjuster of the type mentioned at the outset, in that at least one end slotted gate is provided on the second component, with which the first locking bolt or the second locking bolt engages in its locking position in an end angular position which deviates from the central angular position of the components with respect to each other.

The present invention is based on the consideration that, in the case of a central slotted gate, in which the components of the camshaft adjuster are rotatably fixedly locked in a central angular position with respect to each other, the distance of the locking bolts in the direction of rotation may be selected to be large enough to lock the components with the aid of one of these locking bolts, additionally in another angular position, referred to in the present case as the end angular position. For this purpose, an end slotted gate is provided in addition to the central slotted gate, with which one of the two locking bolts engages in its locking position in an end angular position of the components, which deviates from the central angular position.

The end angular position of the additional lock does not necessarily have to be provided by an end stop position of the components with respect to each other, in which, for example, a vane element of the rotor strikes a separating element of the stator. Instead, the locked end angular position may also be situated between an end stop position and the central angular position. However, the end angular position of the components with respect to each other is preferably provided by an end stop position, with the aid of which the relative rotation of the components with respect to each other is limited. In this case, a defined angular position, in which the locking bolt may engage with the end slotted gate, is provided by the striking of the components in the direction of rotation. Therefore, the end slotted gates may be provided with a comparatively simple design. It must only be ensured that the end slotted gate, including the engaging locking bolt, form an at least one-sided form fit counter to the stop side.

The present invention therefore provides a camshaft adjuster, which offers a locking capability of the rotatable components in two different angular positions, in particular in a central angular position and in an end angular position, which may correspond to an end stop position, using only two locking bolts. In terms of its locking characteristics, the camshaft adjuster does not differ from a comparable camshaft adjuster according to the prior art. In particular, the central locking takes place with the same security and precision. However, the present invention makes do with one less locking bolt, so that the overall construction may be smaller and lighter in weight, more installation space is provided in the camshaft adjuster for other components, e.g., for a compensating spring, etc., or a design variant of the camshaft adjuster may be selected which as such has installation space only for two locking bolts.

In principle, the orientation of the locking bolts is arbitrary. Thus, the locking bolts may be movably guided, for example, in the radial direction. For structural reasons, however, in one advantageous embodiment, the locking bolts are movably guided in the axial direction. In this variant, for example, the slotted gates, with which the locking bolts of the rotor engage axially in their locking position, are introduced into the cover of the stator.

The locking bolts are preferably guided, pretensioned against a restoring means. This offers control advantages, since the locking bolts strive to assume their locking positions, due to the active restoring force, if the controller fails or the internal combustion engine comes to a stop. The locking bolts are advantageously movable hydraulically, in particular guided against a mechanical restoring means such as a spring. A pressure medium may be advantageously applied to the slotted gates for hydraulic actuation, so that the locked locking bolts are lifted out of their locking position into their unlocking position, or unlocked locking bolts are unable to lock against the pressure medium. In one preferred design variant, the lubricant of the internal combustion engine is used as the pressure medium for hydraulic actuation of the locking bolts.

In one advantageous embodiment of the camshaft adjuster, an additional central slotted gate is provided on the second component, the two locking bolts engaging with one of the central slotted gates in their locking position in the central angular position of the components with respect to each other. In other words, in this design variant, two separate central slotted gates are provided for locking in the central angular position of the components. In the locked state, each of the locking bolts engages with the central slotted gate assigned thereto. In particular, the two central slotted gates extend away from the locking bolts in opposite directions of rotation, viewed from the locked state. Thus, when the components rotate with respect to each other, one of the locking bolts first enters the associated central slotted gate for locking purposes and finally strikes the end of the central slotted gate only upon further rotation. The other locking bolt comes into engagement with the other central slotted gate only in this position and may enter therein, so that the components are now locked against both directions of rotation. When the direction of rotation changes, the central slotted gates switch roles accordingly.

In the event of one cohesive or two separate central slotted gates, the one or each of the central slotted gates is wider in the direction of rotation of the components than the engaging locking bolt for the purpose of improving the locking mechanism, so that the locking bolts counteractively strike the one or multiple central slotted gate(s) in their locking position when the components are in the central angular position. The one locking bolt is initially caught by one of the central slotted gate(s) during the movement of the components and finally strikes the end of the central slotted gate in the inserted position. A defined angular position is provided thereby, in which the second locking bolt is able to assume its locking position.

Another end slotted gate is advantageously provided, the first locking bolt engaging with the one end slotted gate in its locking position in a first end angular position of the components with respect to each other, and the second locking bolt engaging with the other end slotted gate in its locking position in a second end angular position of the components with respect to each other. A camshaft adjuster of this type thus offers a locking of the components in a total of three different angular positions, using only two locking bolts.

BRIEF DESCRIPTION OF THE DRAWINGS

Exemplary embodiments of the present invention are explained in greater detail below on the basis of a drawing.

DETAILED DESCRIPTION

Figure 1:
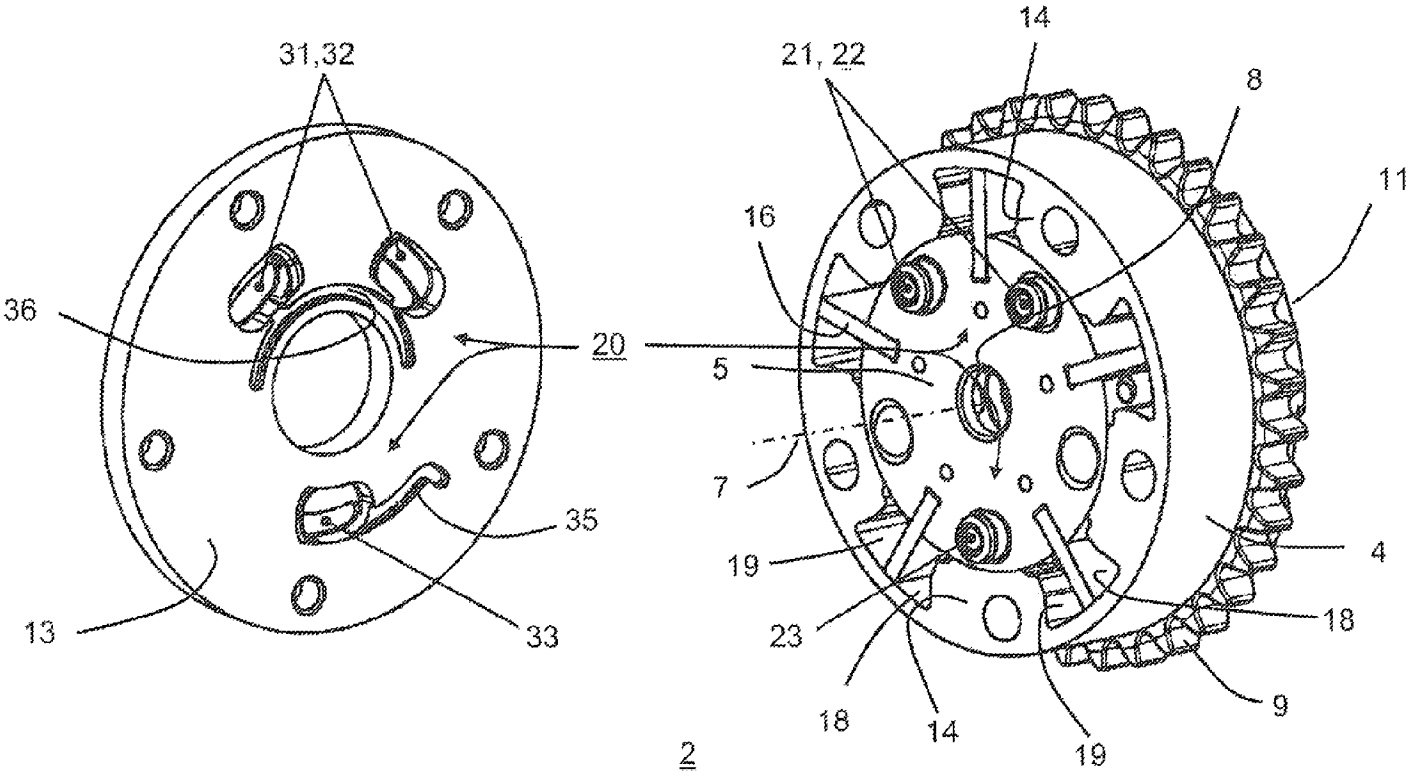
FIG. 1 shows a perspective view of a camshaft adjuster according to the prior art.

Reference is hereby made to FIG. 1, which shows a perspective view of a hydraulic camshaft adjuster 2 according to the prior art, which is not the subject matter of the present invention. Illustrated camshaft adjuster 2 includes a stator 4, in which a rotor 5 is rotatably supported around a rotation axis 7. Rotor 5 has a central bore 8 for fixing to a camshaft, which is not illustrated. A central screw, for example, which may be screwed to the camshaft, is guided through this bore 8. Stator 4 includes an outer wheel 9, which has an outer toothing. Via the outer toothing, stator 4 is coupled with a crankshaft, which is not illustrated, with the aid of a driving means, which is also not illustrated.

Rotor 5 is supported in stator 4 between a sealing cover 11, which is not visible, and a locking cover 13, which is shown in the open state. A number of separating elements 14 project from stator 4 into the interior. One vane element 16 of rotor 5 is situated between two adjacent separating elements 14 of stator 4. Each vane element 16 divides the space between two adjacent separating elements 14 into an advance chamber 18 and a retard chamber 19. The chambers, also referred to together as pressure chambers, are connected to separate, switchable pressure medium lines. If pressure medium is applied, for example, to advance chamber 18, and the pressure medium line of retard chamber 19 is connected to an outlet, rotor 5 is moved forward (advanced) with respect to stator 4. According to FIG. 1, rotor 5 rotates in the clockwise direction with respect to stator 4. Rotor 5 may be adjusted in the clockwise direction until vane elements 16 strike a delimiting separating element 14 in an end "advance" stop position. Conversely, if pressure medium is applied, for example, to retard chamber 19, and the pressure medium line of advance chamber 18 is connected to an outlet, rotor 5 is moved back (retarded) with respect to stator 4. According to FIG. 1, rotor 5 rotates in the counterclockwise direction with respect to stator 4. Rotor 5 may be adjusted in the counterclockwise direction until vane elements 16 strike a delimiting separating element 14 in a "retard" end stop position.

Camshaft adjuster 2 according to FIG. 1 includes a locking device 20, which facilitates a locking of the two components which are rotatable with respect to each other, i.e., stator 4 and rotor 5, in two different angular positions. For this purpose, locking device 20 has a total of three axially movable locking bolts 21, 22, 23, which are supported in rotor 5 and which may engage with assigned slotted gates 31, 32 and 33 in a corresponding angular position between rotor 5 and stator 4.

Each of the two locking bolts 21, 22 engages with one of two assigned central slotted gates 31, 32 in a central angular position. Rotor 5 and stator 4 are locked to each other in the central angular position, in that, in their locking position, locking bolts 21, 22 are in opposite abutment in the two central slotted gates 31, 32. Locking bolt 23 may engage with end slotted gate 33 in the "retard" end stop position of rotor 5 and stator 4. Locking bolts 21, 22, 23 are hydraulically movable against a spring restoring force. For this purpose, oil grooves 35, 36 are each assigned to slotted gates 31, 32, 33. If pressure medium, preferably the lubricant (oil) of the internal combustion engine, is applied to oil grooves 35, 36, locked locking bolts 21, 22, 23 are lifted out of slotted gates 31, 32, 33, or unlocked locking bolts 21, 22, 23 are unable to enter slotted gates 31, 32, 33.

FIGS. 2 through 15 each show schematic representations of design variants of a camshaft adjuster 2, which may lock in at least two different angular positions between rotor 5 and stator 4 with the aid of only two locking bolts 21, 22. Each of the illustrated design variants permits at least one locking action of rotor 5 to stator 4 in a central angular position as well as an additional locking action in at least one end stop position.

In all FIGS. 2 through 15, the space between two adjacent separating elements 14 of stator 4 is shown schematically at the top. It is possible to see the way in which vane element 16 of rotor 5 moves between a "retard" end stop position, a central position and an "advance" end stop position upon corresponding adjustment. The "advance" and "retard" end stop positions each correspond to one end angular position of the components rotor 5 and stator 4 with respect to each other. The central position of vane element 16 corresponds to a central angular position of rotor 5 with respect to stator 4. The two pressure chambers, namely advance chamber 18 and retard chamber 19, are visible in the central position of vane element 16. Advance chamber 18 has its maximum extension in the "retard" end stop position. Retard chamber 19 has its maximum extension in the "advance" end stop position. The other adjusting chamber 19 or 18 is reduced to a volume of "zero" by the striking of the vane element.

In the lower section of each of FIGS. 2 through 15, sealing cover 11 and locking cover 13 of stator 4 are illustrated schematically. Rotor 5 is rotatably supported between sealing cover 11 and locking cover 13. The rotation of rotor 5 in stator 4 is signaled by a double arrow. In rotor 5, two locking bolts 21, 22 are each axially movable against a mechanical restoring means 38. Restoring means 38 is designed as a helical spring in each case. Slotted gates 31, 32, 33, 34, into which corresponding locking bolts 21, 22 may enter or with which they may engage in a corresponding angular position between rotor 5 and stator 4, are introduced into locking cover 13. Pressure medium may be applied to slotted gates 31, 32, 33, 34 for the purpose of actuating locking bolts 21, 22 against the restoring force.

Figure 2:
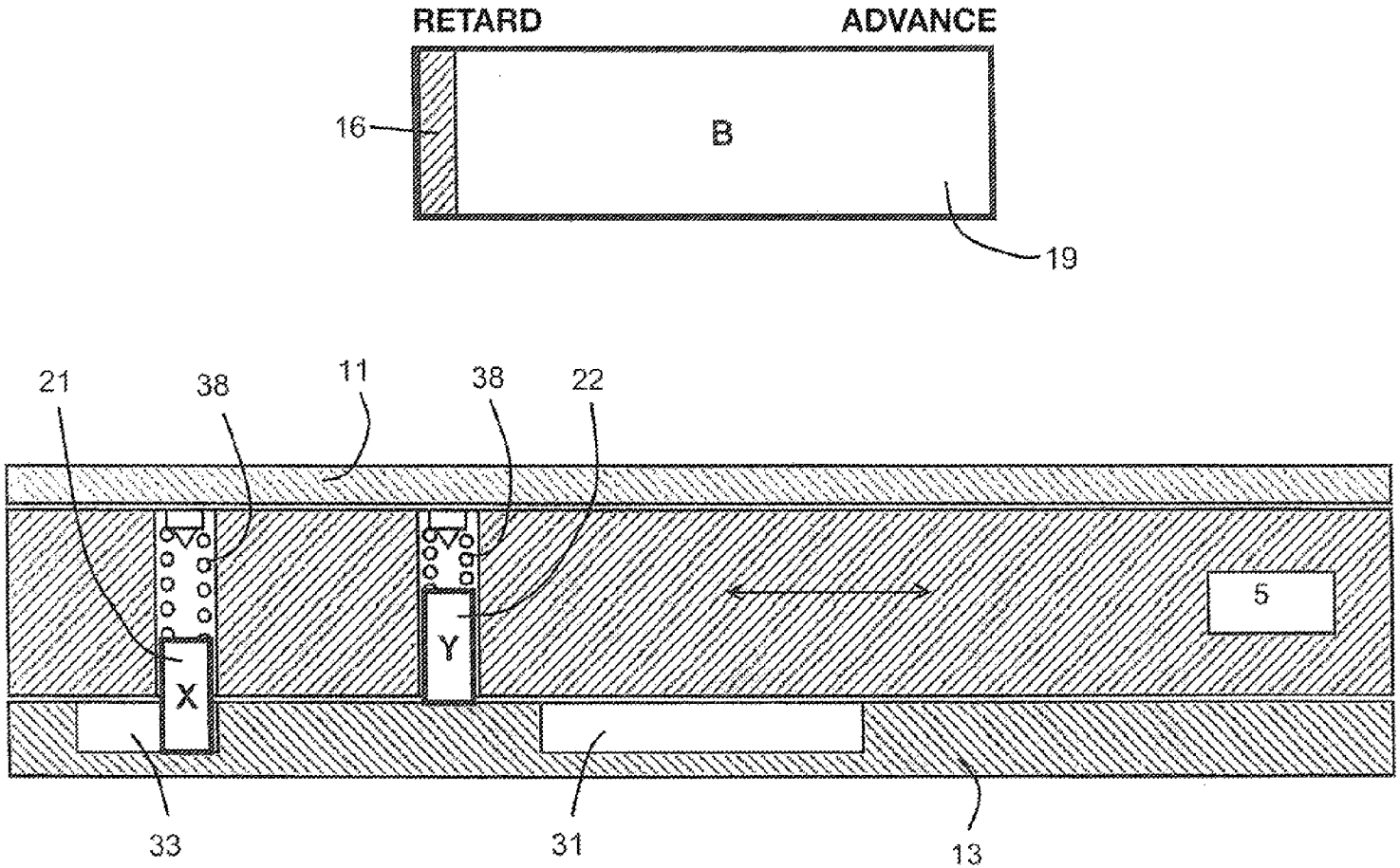
FIGS. 2, 3 show a schematic representation of a first design variant of a camshaft adjuster, with locking in a central and a "retarded" angular position.
Figure 3:
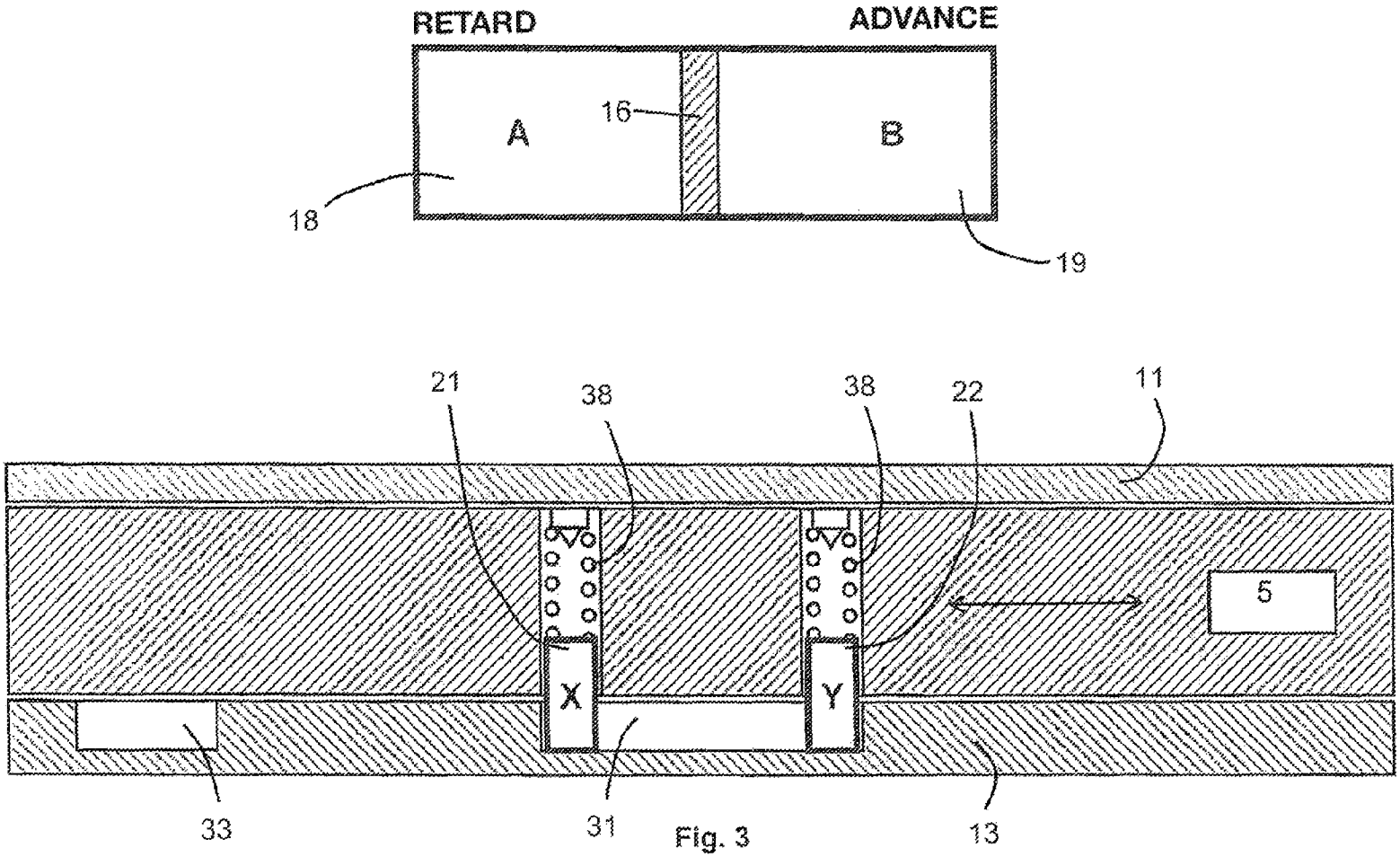

A first design variant of a camshaft adjuster 2 is illustrated in FIGS. 2 and 3. Locking cover 13 has a central slotted gate 31 and an end slotted gate 33. In a central angular position of the components with respect to each other according to FIG. 3, both locking bolts 21, 22 jointly engage with central slotted gate 31 having a counteractive stop in their locking position. In a "retard" end stop position according to FIG. 2, locking bolt 21 engages with end slotted gate 33 in its locking position. It is not possible for rotor 5 to further rotate, since vane element 16 strikes a separating element 14 of stator 4. Second locking bolt 22 is lifted.

If rotor 5 rotates to the "right," based on FIG. 2, and if a locking action is provided, second locking bolt 22 may first enter central slotted gate 31 and then strike the "right" end of central slotted gate 31. In this position, first locking bolt 21 may also enter central slotted gate 31. Both components 4, 5 are locked in both directions of rotation.

Figure 4:
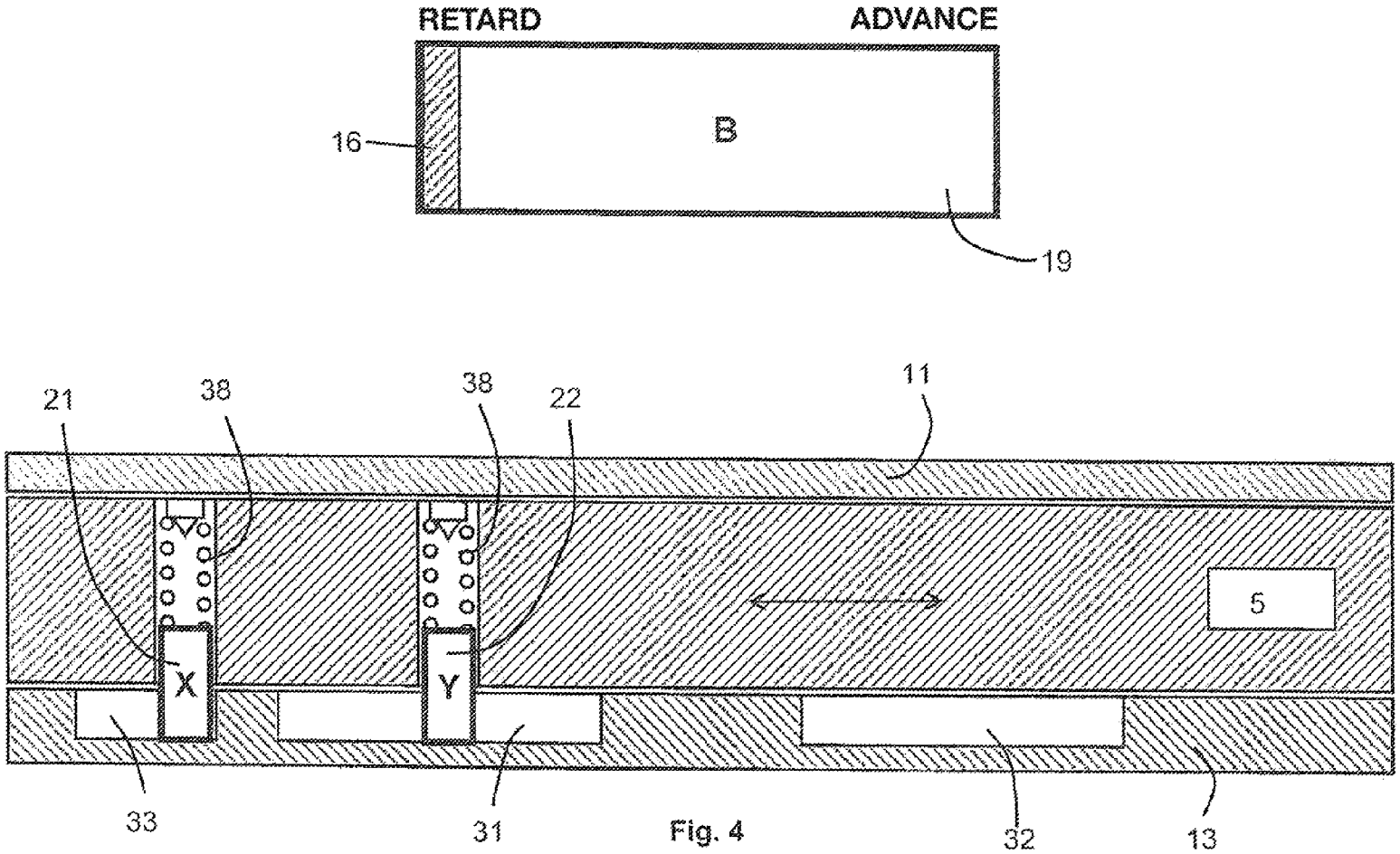
FIGS. 4, 5 show a schematic representation of a second design variant of a camshaft adjuster, with locking in a central and a "retarded" angular position.
Figure 5:
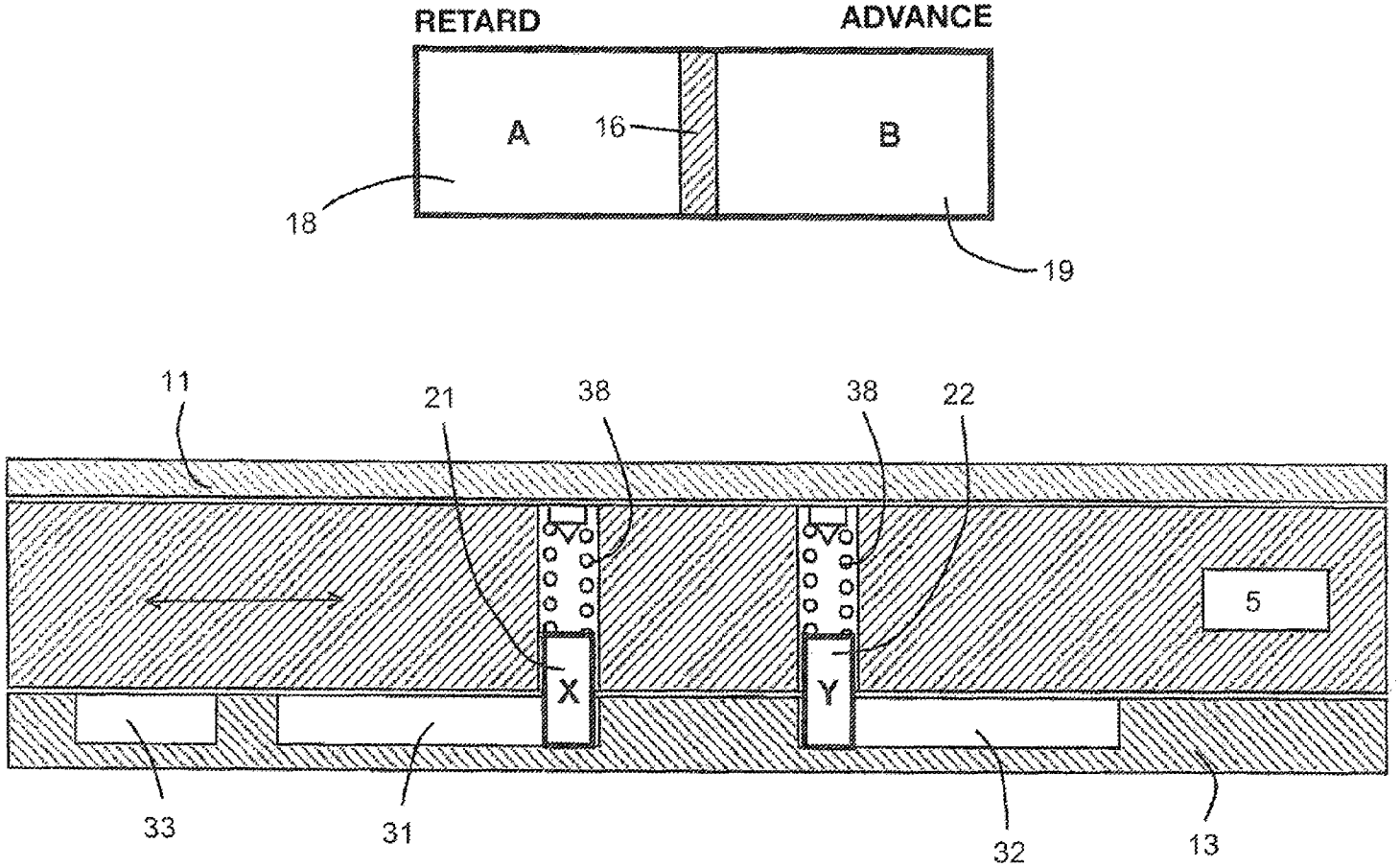

A second design variant of a camshaft adjuster 2 is illustrated in FIGS. 4 and 5. In contrast to the first design variant according to FIGS. 2 and 3, two central slotted gates 31, 32 are now provided in locking cover 13. FIG. 4 shows the lock in the "retard" end stop position. Second locking bolt 22 may remain locked in first central slotted gate 31. FIG. 5 shows the lock in a central angular position between rotor 5 and stator 4. For locking in the central angular position, first locking bolt 21 engages with first central slotted gate 31, and second locking bolt 22 engages with second central slotted gate 32. Counteractive stops are again formed in particular slotted gates 31, 32 with the aid of locking bolts 21, 22.

Figure 6:
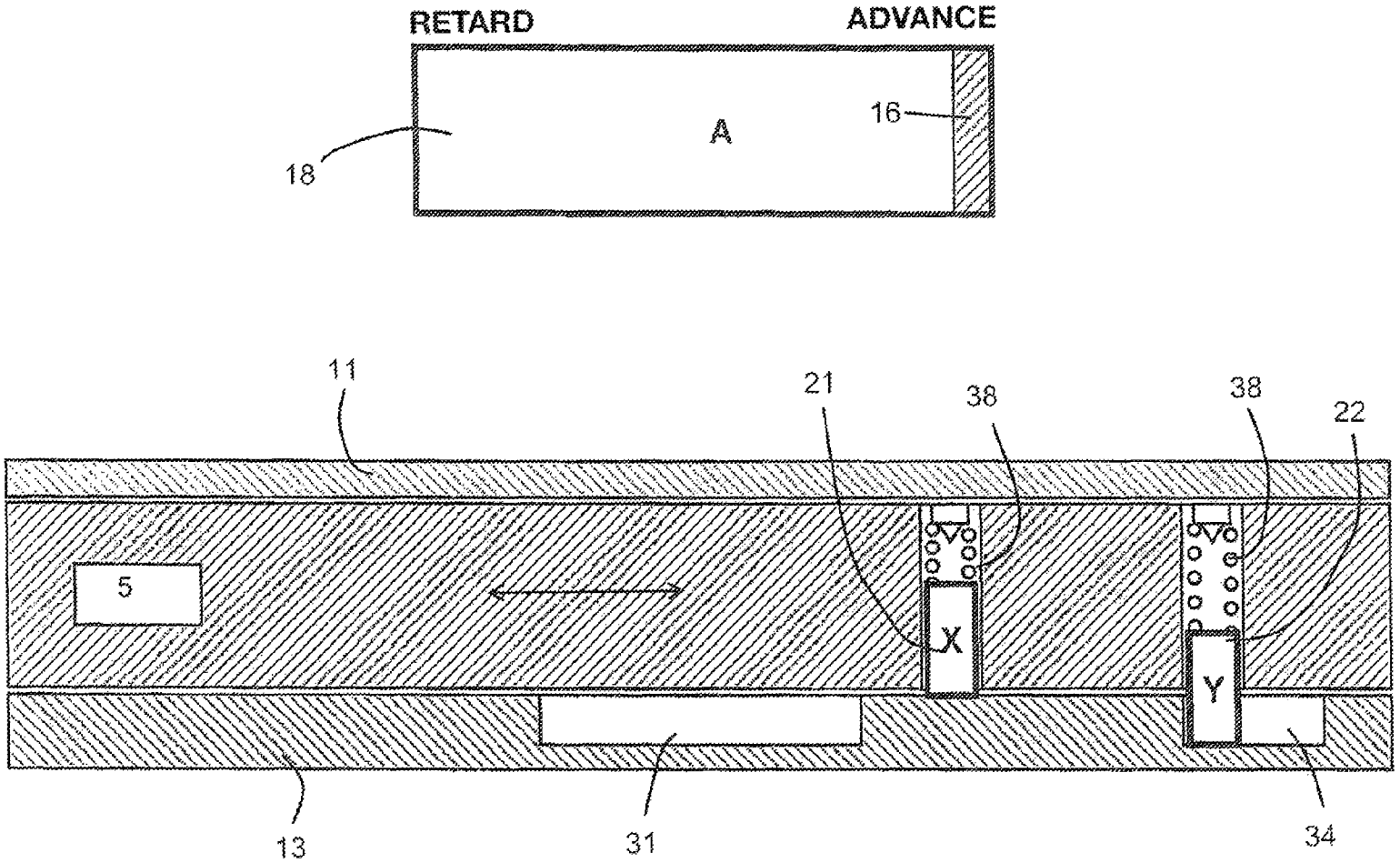
FIGS. 6, 7 show a schematic representation of a third design variant of a camshaft adjuster, with locking in a central and an "advanced" angular position.
Figure 7:
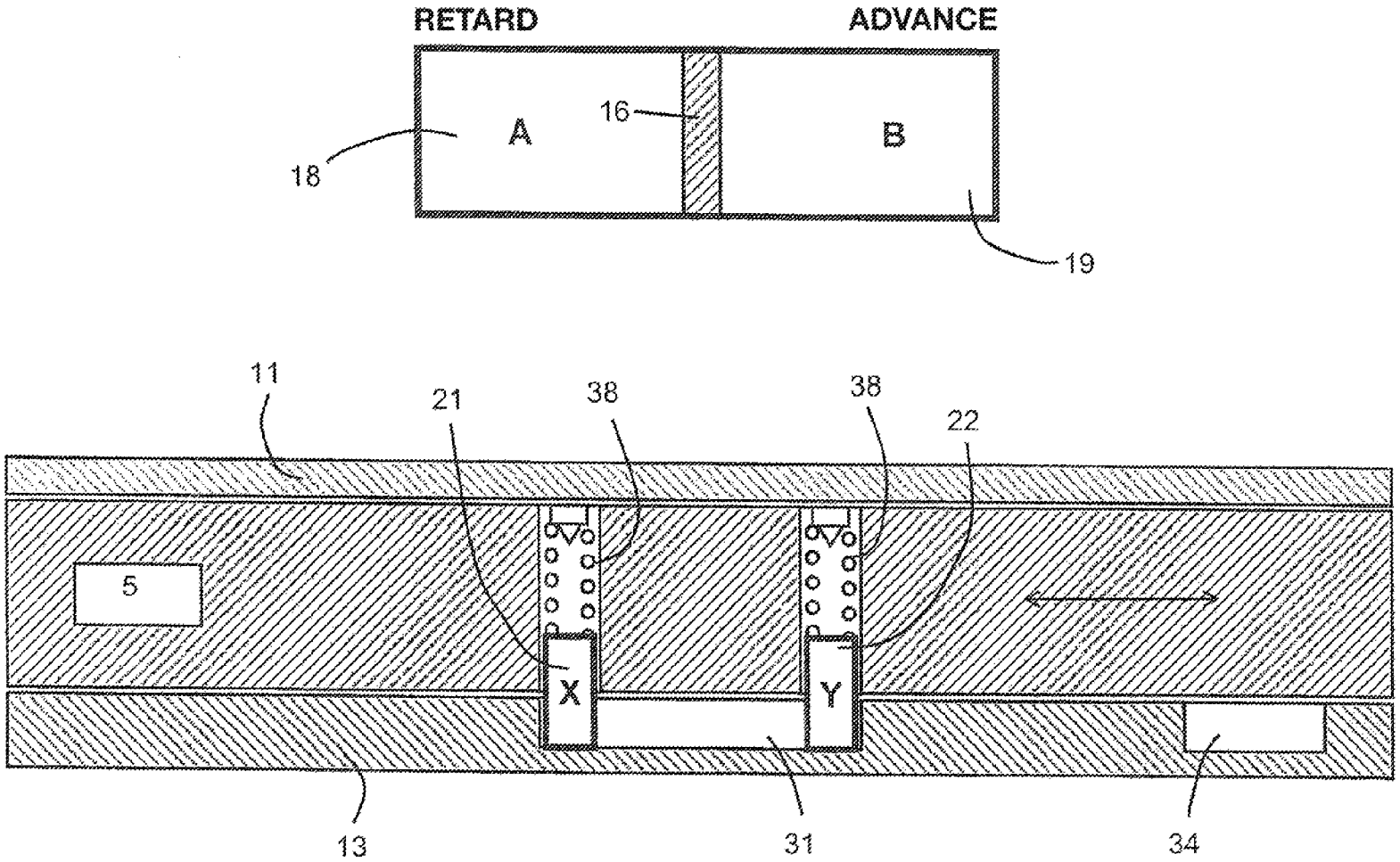

A third design variant of a camshaft adjuster 2 is illustrated in FIGS. 6 and 7. This design variant essentially corresponds to the first design variant according to FIGS. 2 and 3; however, according to FIG. 7, a locking action in the "advance" end stop position is facilitated by end slotted gate 34 in addition to a locking position in a central angular position.

According to FIG. 6, second locking bolt 22 enters end slotted gate 34. First locking bolt 21 remains lifted.

Figure 8:
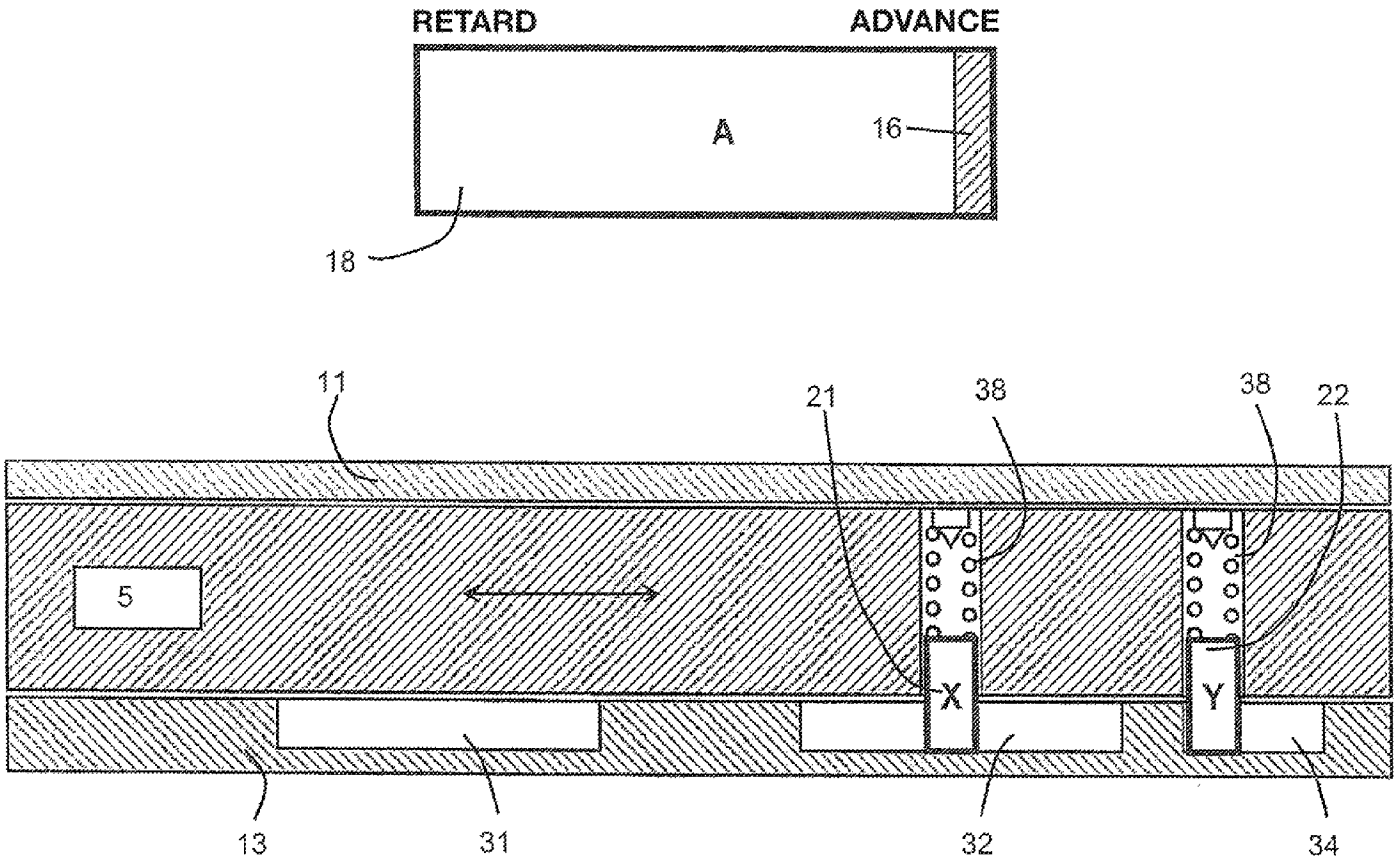
FIGS. 8, 9 show a schematic representation of a fourth design variant of a camshaft adjuster, with locking in a central and an "advanced" angular position.
Figure 9:
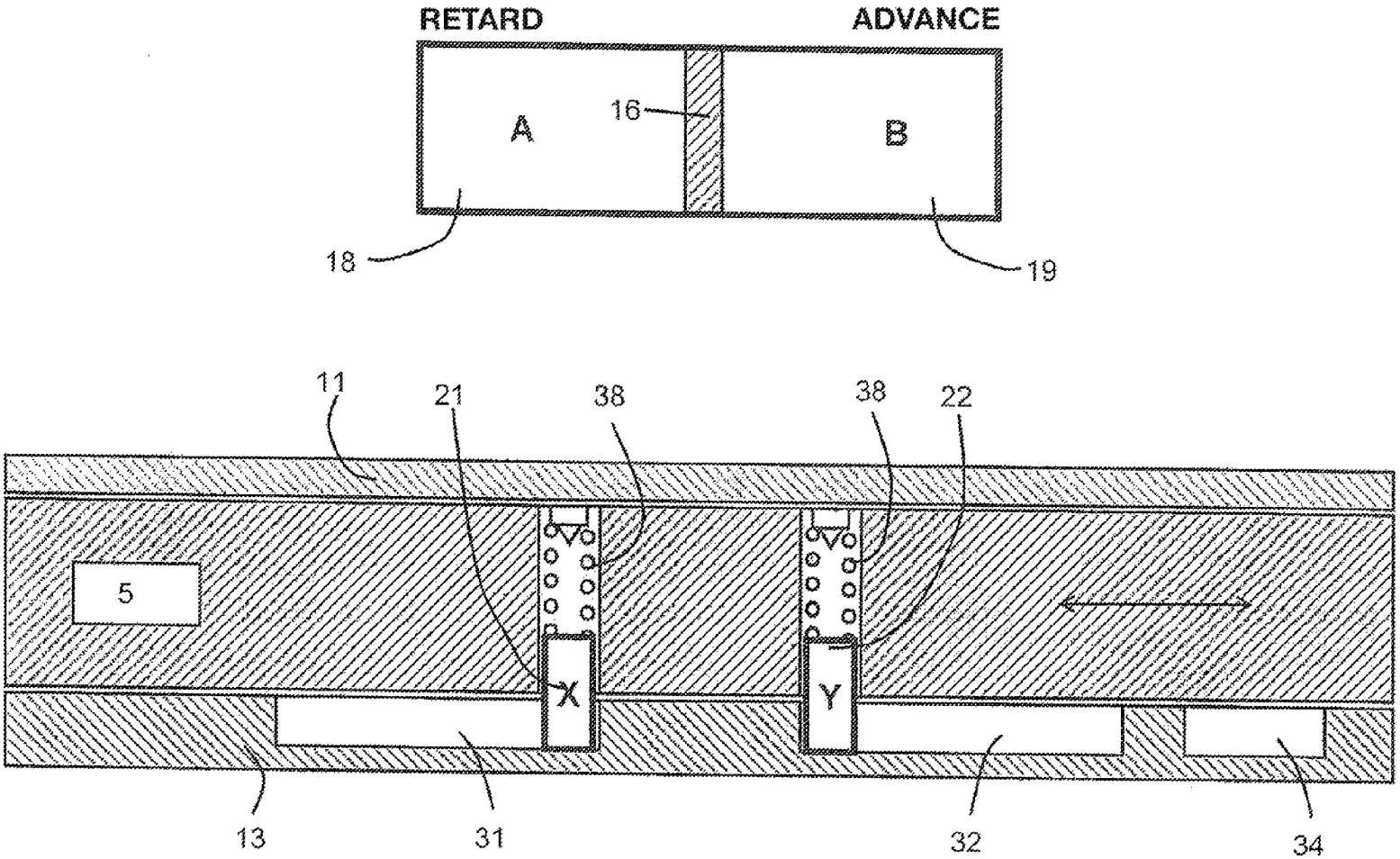

FIGS. 8 and 9 show a fourth design variant of a camshaft adjuster 2, which essentially corresponds to the second design variant according to FIGS. 4 and 5. In contrast to the second design variant, however, an end slotted gate 34 is now provided, which permits a locking action in the "advance" end stop position (see FIG. 8). First locking bolt 21 may remain locked in second central slotted gate 32. FIG. 9 shows the lock in a central angular position between rotor 5 and stator 4. For locking in the central angular position, first locking bolt 21 engages with first central slotted gate 31, and second locking bolt 22 engages with second central slotted gate 32. Counteractive stops are again formed in particular slotted gates 31, 32 with the aid of locking bolts 21, 22.

Figure 10:
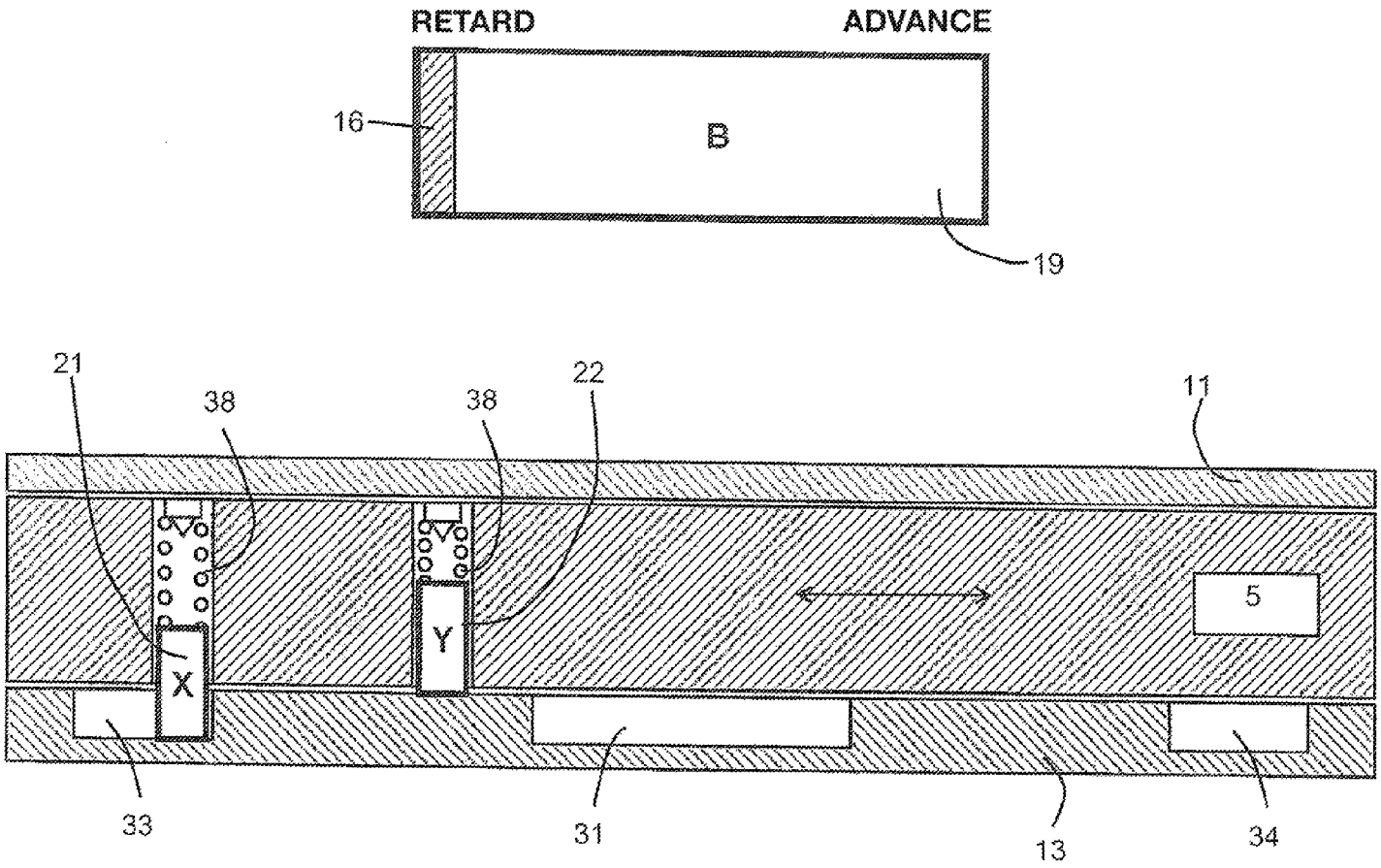
FIGS. 10 through 12 show a schematic representation of a fifth design variant of a camshaft adjuster, with locking in a central, an "advanced" and a "retarded" angular position.
Figure 11:
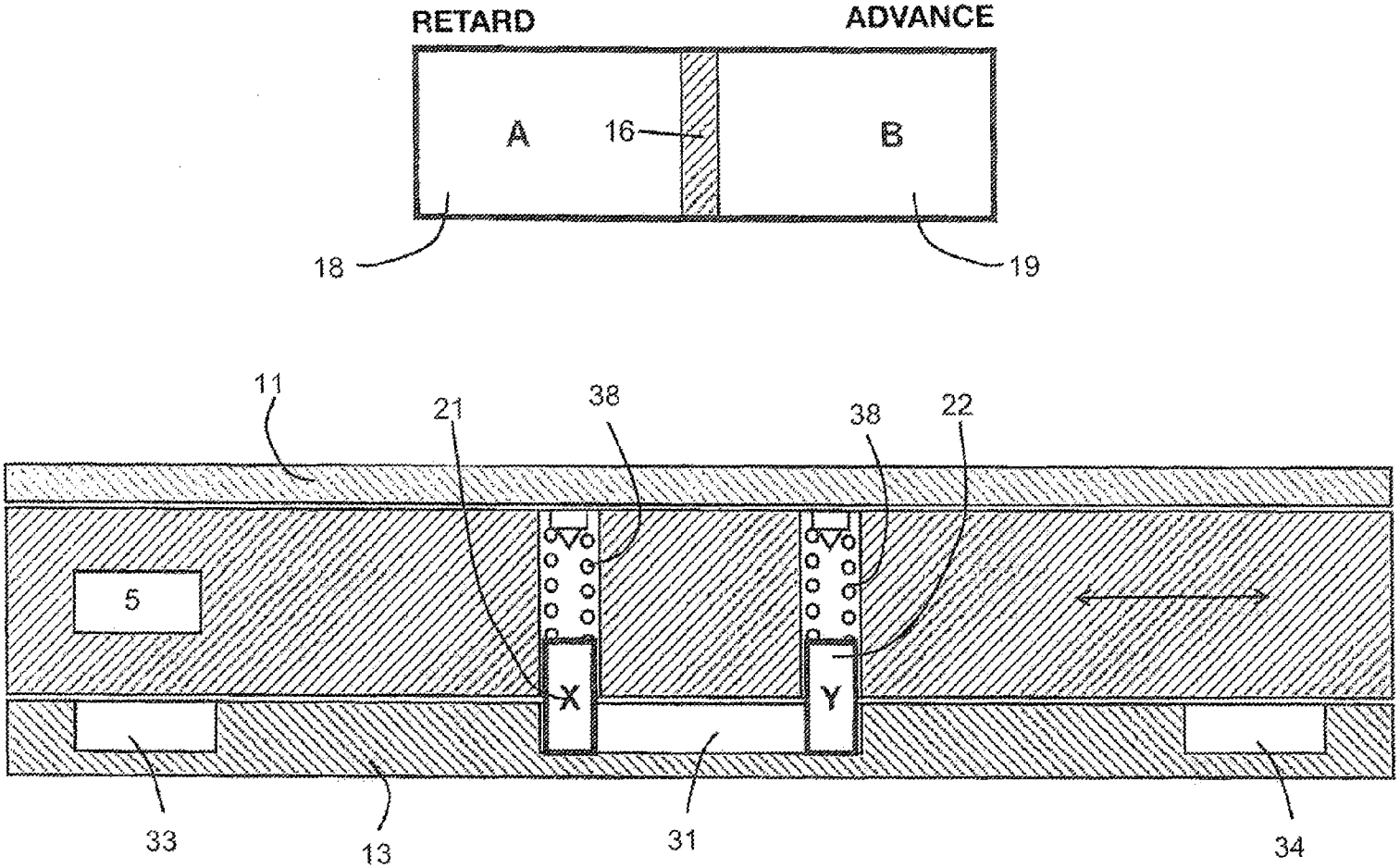
Figure 12:
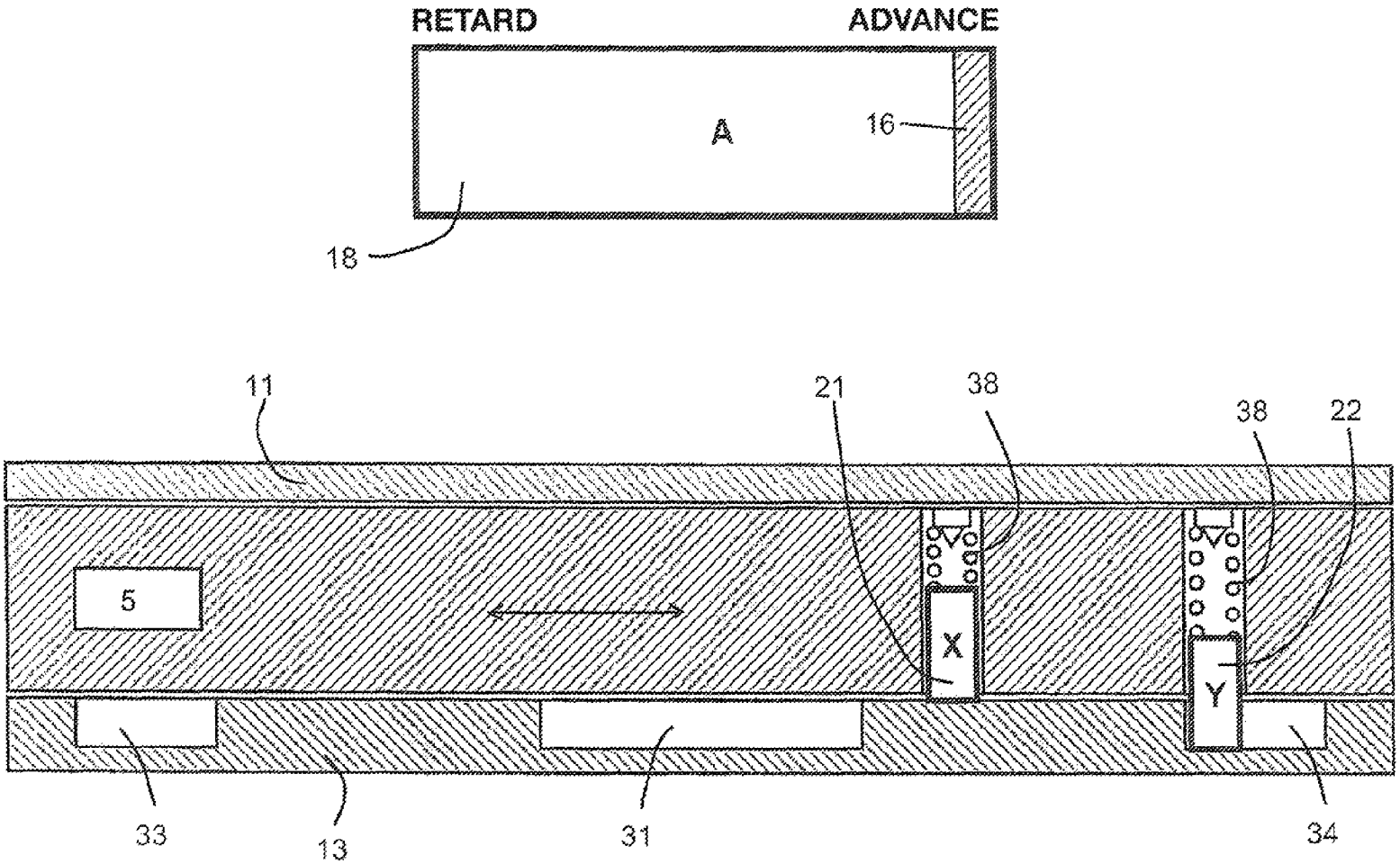

A fifth design variant of a camshaft adjuster 2 is illustrated in FIGS. 10 through 12. The fifth design variant is a combination of the first and third design variants. In addition to central slotted gate 31, a first end slotted gate 33 and a second end slotted gate 34 are provided in locking cover 13. This design variant permits a locking of rotor 5 and stator 4 in three different angular positions: in a "retard" end stop position (FIG. 10), in a central angular position (FIG. 11) and in an "advance" end stop position (FIG. 12).

Figure 13:
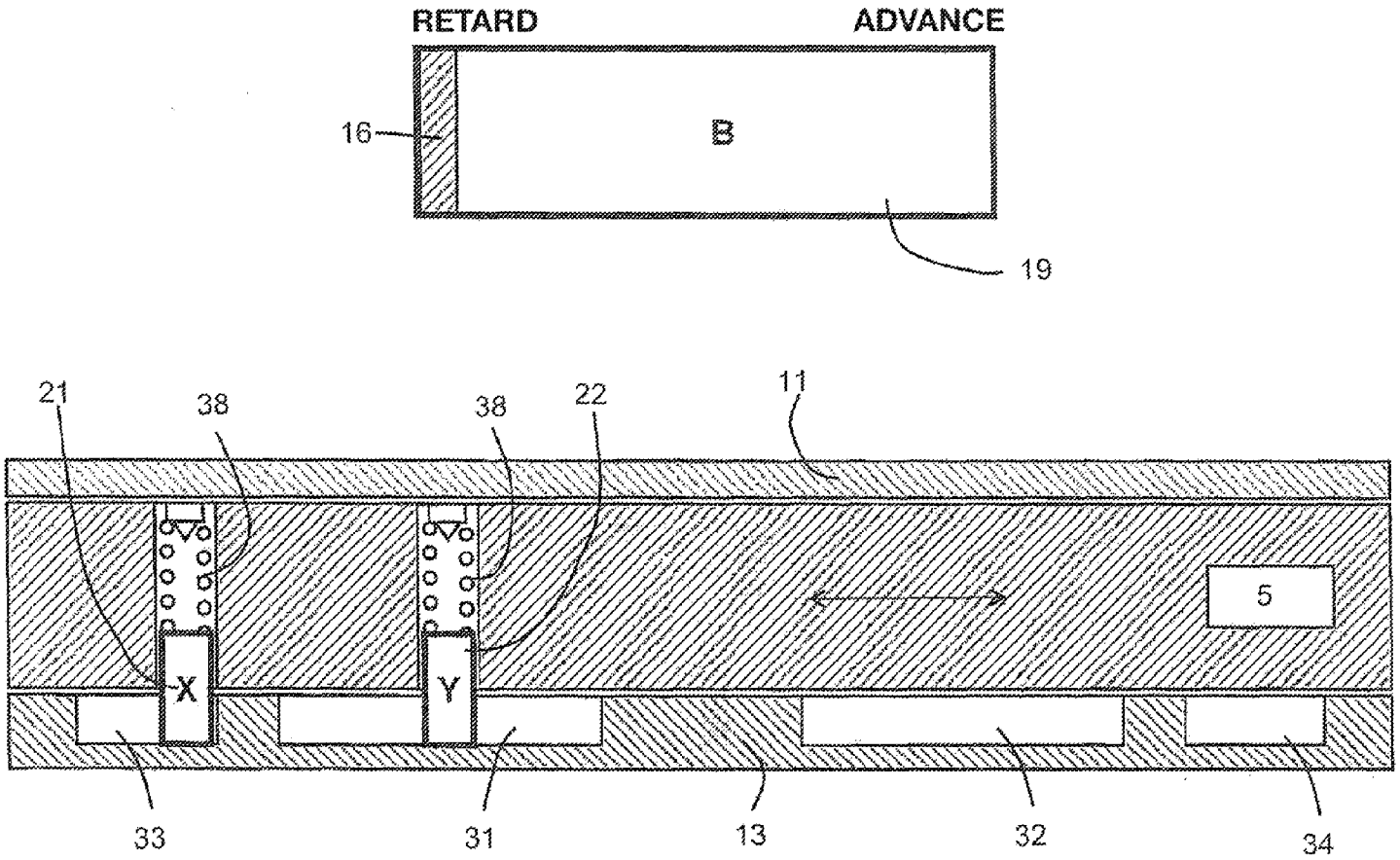
FIGS. 13 through 15 show a schematic representation of a sixth design variant of a camshaft adjuster, with locking in a central, an "advanced" and a "retarded" angular position.
Figure 14:
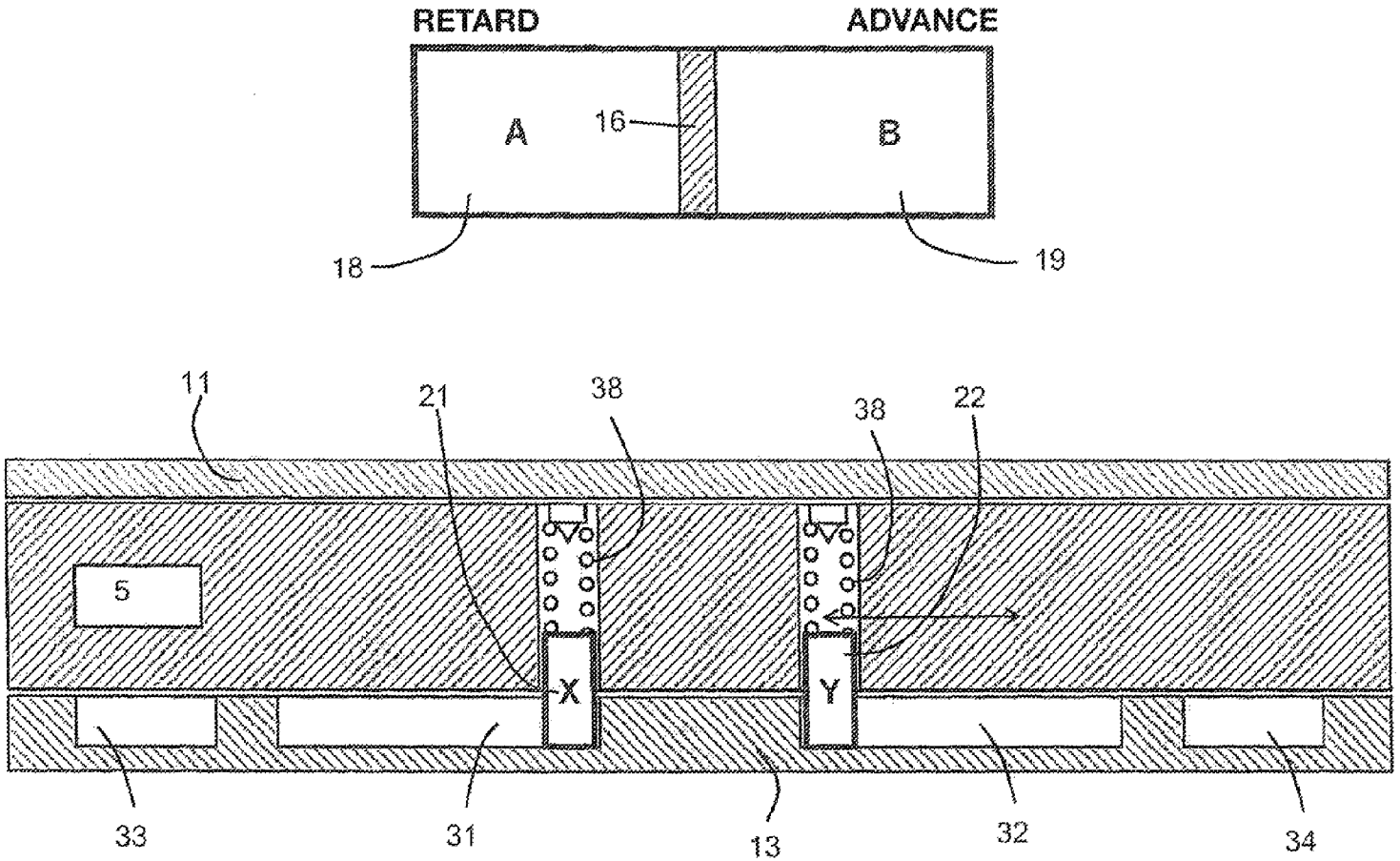
Figure 15:
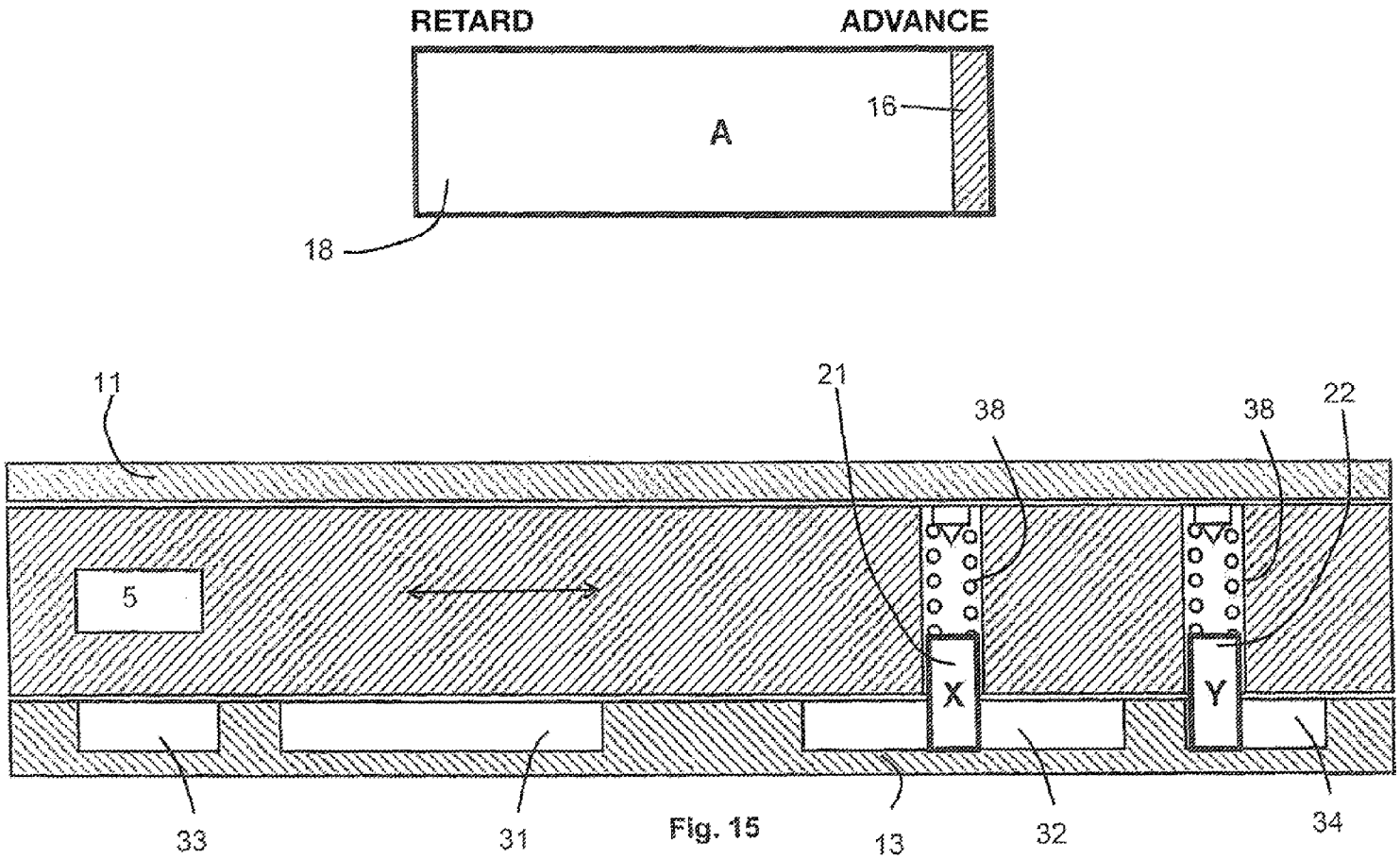

A sixth design variant of a camshaft adjuster 2 is illustrated in FIGS. 13 through 15. The sixth design variant is a combination of the second and fourth design variants. In addition to a first central slotted gate 31 and a second central slotted gate 32, a first end slotted gate 33 and a second end slotted gate 34 are provided in locking cover 13. This design variant permits a locking of rotor 5 and stator 4 in three different angular positions: in a "retard" end stop position (FIG. 13), in a central angular position (FIG. 14) and in an "advance" end stop position (FIG. 15). The sixth design variant differs from the fifth design variant by the fact that two separate central slotted gates 31, 32 are provided.

LIST OF REFERENCE NUMERALS

2 Camshaft adjuster
4 Stator
5 Rotor
7 Rotation axis
8 Bore
9 Outer wheel
11 Sealing cover
13 Locking cover
14 Separating elements
16 Vane element
18 Advance chamber
19 Retard chamber
20 Locking device
21 Locking bolt
22 Locking bolt
23 Locking bolt
31 Central slotted gate
32 Central slotted gate
33 End slotted gate (retard)
34 End slotted gate (advance)
35 Oil groove
36 Oil groove
38 Restoring means

What is claimed is:

1. A camshaft adjuster comprising:

a first component;

a second component rotatable relative to the first component around a rotation axis within an angular range; and a locking device for locking the first component with respect to the second component, the locking device including a first locking bolt and a second locking bolt on the first component and at least one central slotted gate on the second component, and the first and second locking bolts being movably guided between a locking position and an unlocking position and engaging at least with the one central slotted gate in their locking positions in a central angular position of the first and second components with respect to each other, at least one end slotted gate being provided on the second component, the first locking bolt or the second locking bolt engaging with the end slotted gate in the locking position in an end angular position deviating from the central angular position of the first and second components.

2. The camshaft adjuster as recited in claim 1 wherein another central slotted gate is provided on the second component, the first and second locking bolts engaging with the central slotted gate or the other central slotted gate in the locking position in the central angular position of the first and second components with respect to each other.

3. The camshaft adjuster as recited in claim 2 wherein the central slotted gate or the other central slotted gate is wider in the direction of rotation of the first and second components than the engaging first and second locking bolts, the first and second locking bolts counteractively striking the central slotted gate or the other central slotted gate in the locking position in the central angular position of the first and second components.

4. The camshaft adjuster as recited in claim 1 wherein another end slotted gate is provided, the first locking bolt engaging with the one end slotted gate in the locking position in a first end angular position of the first and second components with respect to each other, and the second locking bolt engaging with the other end slotted gate in the locking position in a second end angular position of the first and second components with respect to each other.

5. The camshaft adjuster as recited in claim 1 wherein the first and second locking bolts are each movably guided in the axial direction.

6. The camshaft adjuster as recited in claim 1 wherein the first and second locking bolts are each guided, pretensioned against a restorer.

7. The camshaft adjuster as recited in claim 1 wherein the first and second locking bolts are each hydraulically movable.

8. The camshaft adjuster as recited in claim 1 wherein a pressure medium is applied to the central and end slotted gates for the purpose of hydraulically actuating the first and second locking bolts from the locking position to the unlocking position.

9. The camshaft adjuster as recited in claim 1 wherein the end angular positions of the first and second components with respect to each other correspond to the end stop positions, with the aid of which the relative rotation of the first and second components with respect to each other is limited.

* * * * *